United States Patent [19]

Konno et al.

[11] 3,989,979

[45] Nov. 2, 1976

[54] MAGNETRON EMPLOYING A PERMANENT MAGNET FORMED OF A MANGANESE-ALUMINUM-CARBON SYSTEM ALLOY

[75] Inventors: Isago Konno, Neyagawa; Tadao Ohtani, Katano, both of Japan

[73] Assignee: Matsushita Electric Industrial Co., Ltd., Osaka, Japan

[22] Filed: July 29, 1975

[21] Appl. No.: 600,130

[30] Foreign Application Priority Data

| | | |
|---|---|---|
| Aug. 3, 1974 | Japan | 49-89253 |
| Mar. 26, 1975 | Japan | 50-37106 |
| Mar. 26, 1975 | Japan | 50-37107 |

[52] U.S. Cl. ..... 315/39.51; 315/39.71; 315/39.77; 335/210; 335/296

[51] Int. Cl.[2] ..... H01J 25/50

[58] Field of Search ..... 315/39.51, 39.71, 39.77; 335/210, 296

[56] References Cited

UNITED STATES PATENTS

| | | | |
|---|---|---|---|
| 2,305,781 | 12/1942 | Helbig | 315/39.71 X |
| 3,376,466 | 4/1968 | Gerard | 315/39.71 |
| 3,412,285 | 11/1968 | Gerard | 315/39.77 X |
| 3,843,904 | 10/1974 | Brown | 315/39.71 |
| 3,855,498 | 12/1974 | MacMaster et al. | 315/39.71 |

*Primary Examiner*—Saxfield Chatmon, Jr.
*Attorney, Agent, or Firm*—Stevens, Davis, Miller & Mosher

[57] ABSTRACT

A magnetron comprising means for applying a magnetic field in a direction perpendicular to an electric field established between an anode and a cathode, the magnetic field applying means including a permanent magnet formed of a manganese-aluminum-carbon system alloy and disposed within an enclosure member in which an interaction space for electrons is formed, or used as part of the enclosure member.

11 Claims, 10 Drawing Figures

MAGNETRON EMPLOYING A PERMANENT MAGNET FORMED OF A MANGANESE-ALUMINUM-CARBON SYSTEM ALLOY

This invention relates to a magnetron device, and more particularly to a magnetron device using an anisotropic magnet formed of a manganese (Mn)-aluminum (Al)-carbon (C) system alloy as the permanent magnet.

A magnetron used as a microwave oscillator in an electronic oven comprises a magnetron tube which is assembled in an evacuated vessel and a magnetic circuit including a permanent magnet.

Conventionally, permanent magnets for use in magnetrons have been usually formed of Alnico series or ferrite series magnets and disposed outside the vacuum vessel as is shown in FIGS. 1 and 2.

In FIGS. 1 and 2, numeral 1 denotes a permanent magnet for supplying magnetic energy to the interaction space, 2*a* and 2*b* magnetic yoke members of high magnetic permeability and high saturation magnetic induction for forming a magnetic circuit, 3*a* and 3*b* magnetic pole piece members for effectively supplying magnetic energy to the interaction space, 4 anode vanes forming a radio-frequency resonance circuit, 5 a direct heater cathode, 6 an antenna for radiating radio-frequency electromagnetic waves, 7 an anode cylinder, and 8 a heat radiator.

FIG. 1 shows an example of a magnetron structure adapted for use with a permanent magnet having high residual induction but small coercive force such as Alnico magnets. The feature of the magnetic circuit in a magnetron is that high magnetic induction is required in the interaction space for electrons having a low permeance path and hence a magnet of large magnetomotive force is required. Since the permeance at the optimum performance point of Alnico magnets conventionally used in magnetrons is of the order of 18 G/Oe, a long magnet is needed and, as is shown in FIG. 1, is disposed around a magnetron tube for forming a magnetron device to give a low profile. In the case of FIG. 1, however, since the magnet 1 and the pole piece members 3*a* and 3*b* are separated by a considerable distance, the magnetic yoke members 2*a* and 2*b* offer a large leak permeance. Further, the leak permeance of the pole piece members 3*a* and 3*b* is also large. Thus, a large leakage arises and the utilization of the magnetic flux becomes low; an efficiency above 1.5 % with respect to the total magnetic flux cannot be expected.

FIG. 2 shows an example of a magnetron structure adapted for use with a permanent magnet of high coercive force and low residual magnetic induction, such as anisotropic ferrite magnets. A permanent magnet is disposed under a magnetron tube. A ferrite magnet has a large coercive force and thus the longitudinal length of the magnet can be reduced by a factor of about ½ compared to the case of FIG. 1 using an Alnico magnet. Further, since the magnet 1 in FIG. 2 is disposed near the pole piece member 3*b* and the leakage of magnetic flux is small, the utilization of the magnetic flux becomes better. If, however, a ferrite magnet is designed to have an optimum performance point at room temperature, the coercive force decreases when exposed to low temperatures and a large irreversible demagnetization occurs. Hence, the device should be used at a higher performance point, i.e. under a worse condition at which the magnetic efficiency is low. Further, since the residual magnetic induction is small, the magnet requires a large cross section and the magnetic flux from the magnet should be condensed in the magnetic yoke members 2*a* and 2*b* to supply a high magnetic induction to the pole piece members 3*a* and 3*b*. Therefore, a large leak permeance is inevitable between the yoke members 2*a* and 2*b*, and hence gives a large leak flux. Efficiencies above 2.5 % for the magnetic flux cannot be expected. Regarding the height of the magnetron device, since the permanent magnet is disposed under the magnetron tube, the height is of similar order to that in the case of FIG. 1. Even with the use of a recently developed high performance magnet of the rare earth-cobalt system, reductions in height above 15 % are extremely difficult from the relation with the performance conditions for the magnetron.

Since the magnetic circuits for magnetrons constructed as has been described above, it has been difficult to magnetize the magnet with full charge after assembly of the magnetic circuit and it has, therefore been magnetized before assembly; hence the performance point shifts far from the optimum performance point and utilization of the magnetic flux also becomes very low.

Recently, in electronic ovens, it has been desired to achieve miniaturization, weight reduction, a wider oven space, and high electric efficiency for saving electric power. Thus, magnetrons of thinner and lighter structure, high efficiency and low manufacturing cost have been desired. According to the conventional structures, however, there are drawbacks in that leakage is large which leads to poor utilization of the magnetic flux and to the necessity of a large magnet for providing a sufficient magnetic induction in the gap of the interaction space for electrons. This causes the total size of the magnetron to be large and makes it difficult to reduce the height in connection withh the characteristics of the permanent magnet. In short, further improvement with respect to miniaturization, weight reduction, etc. of electronic ovens can hardly be expected using the conventional structures.

Therefore, an object of this invention is to provide a high performance magnetron having a structure which gives a high magnetic flux utilization efficiency.

Another object of this invention is to provide a magnetron having a structure which enables reduction in the height, weight and size of a magnetron.

According to an embodiment of this invention, there is provided a magnetron comprising an enclosure member for forming therein an interaction space for electrons, an anode and a cathode contained in the enclosure member, and means for applying magnetic field including at least one permanent magnet for supplying magnetic energy to said interaction space and pole piece means for establishing a magnetic field perpendicularly to an electric field established between the anode and the cathode, the permanent magnet being formed of a manganese-aluminium-carbon system alloy and being disposed within the enclosure member or defining part of the enclosure member.

Other objects, features and advantages of this invention will become apparent from the following detailed description made in connection with the accompanying drawings, in which.

Hereinbelow, description will be made of the magnetron devices according to preferred embodiments of this invention. Throughout the figures, similar reference numerals denote similar parts.

Figure 3:
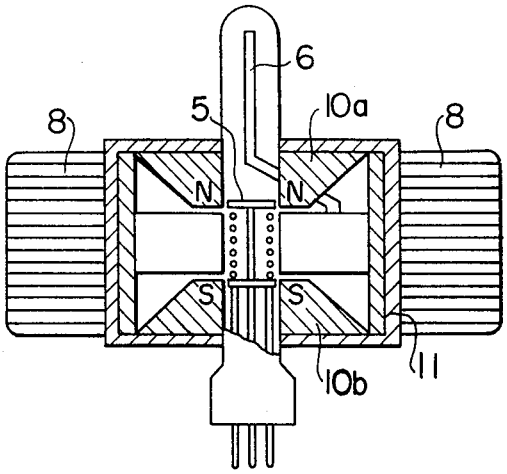
FIG. 3 is a cross section of the structure of a magnetron according to an embodiment of this invention.

A magnetron structure is shown in FIG. 3, in which reference numerals 10*a* and 10*b* denote permanent magnets formed of a manganese-aluminum-carbon (Mn—Al—C) system alloy and working also as pole pieces for supplying magnetic energy to the interaction space. The permanent magnets 10*a* and 10*b* are disposed within an enclosure vessel 11 in which an interaction space for electrons is formed. The enclosure member 11 is, for example, formed of a laminate of an iron layer and a copper layer. The enclosure member 11 may be arranged to work also as an anode and as the magnetic yoke for magnets 10*a* and 10*b*. Further, the magnets may also be formed as part of the enclosure member. The magnet of Mn—Al—C alloy used as the permanent magnets 10*a* and 10*b* and also working as the pole pieces has been described in detail in a copending U.S. patent application, Ser. No. 491,498 of the present inventors. The magnet is formed by melting and casting a basic composition of 68.0 to 73.0 weight % of manganese (Mn), (1/10 Mn − 6.6) to (⅓ Mn − 22.2) weight % of carbon (C) and the remainder of aluminum (Al), then subjecting the cast material to warm plastic deformation in a temperature range of 530° to 830° C. By the warm plastic deformation, the magnetic properties are greatly improved and machining is also made possible. For example, through a warm extrusion processing, there is provided an anisotropic magnet having a residual magnetic induction of $B_r$ = 6000 to 6500 G, a coercive force of ${}_BH_c$ = 2200 to 2800 Oe and a maximum magnetic energy product of $(BH)_{max}$ = 5.0 to $7.5 \times 10^6$ G·Oe. The present inventors have studied in detail the physical properties of this magnet, not only the magnetic properties but also the thermal, electrical, hermetic and welding properties, are found that this magnet has a large coercive force and accordingly a low permeance of the order of 1 to 3 G/Oe at the optimum performance point. In comparison with ferrite magnets the temperature coefficient of remanence in this magnet is small and demagnetization at a low temperature is less than − 2 % to the temperature of − 180° C, the thermal and electrical conductivities are very good and further it is strongly resistant to thermal shocks and can be welded or silver-soldered. The thermal expansion coefficient is almost equal to that of copper, and the material is dense from the metalographic viewpoint; hence almost no out-gas nor absorbed gas molecules could be found and thus the material can be used as part of a vacuum vessel. Further, it was found that the mechanical strength is not only very high (that is, several times higher than those of conventional permanent magnets) but that accurate processing of the inner and outer diameters, etc. are possible by lathe processing in a magnetic phase. Further, a Mn—Al—C system magnet plastically deformed to be tapered as shown in FIG. 3 has the following characteristics: The focusing effect for the magnetic flux, obtained by tapering a tip end of the magnet is similar to that of conventional pole pieces and further, in Mn—Al—C system magnets the magnetic properties of the magnet become better as the position approaches a sharp point; i.e. as the magnet is converged to a larger extent. Also the coercive force becomes larger as the position approaches the periphery in a radial direction. As a result, the leak magnetic flux is reduced. Hence, as the result of the combination effect of these phenomena, the focusing effect of the magnetic effect at the tip portion of the magnet becomes far better than that of conventional magnets.

Now, embodiments of the invention will be described in detail.

(EMBODIMENT 1)

Figure 4:
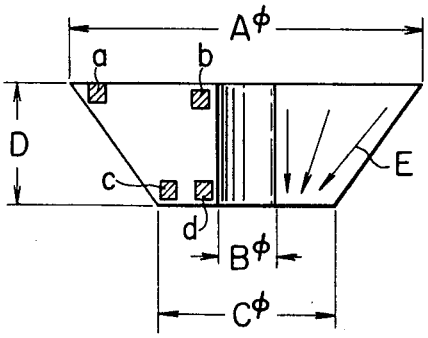
FIG. 4 is a cross section of a permanent magnet used in the magnetron of FIG. 3.

Referring to FIG. 4, the manufacture and the properties of a Mn—Al—C magnet will first be described briefly. A cylindrical billet of an outer diameter A $\phi$ and an inner diameter B $\phi$ is cast with a Mn—Al—C series material. After giving an appropriate heat treatment, the billet is subjected to upsetting press in a container to obtain a truncated cone as shown in FIG. 4 at a temperature around 700° C. After this treatment, the material becomes an anisotropic magnet having an easy direction of magnetization along the axial direction of the cone. More precisely, it was found after cutting out small specimens from various portions and precisely measuring the magnetization with a torque meter that the directions of easy magnetization are focused toward the tip of the magnet as illustrated by arrows E in the right half of FIG. 4.

Further, the magnetic properties of the magnet were measured by cutting out small specimens from various portions of the magnet. Typical portions from which specimens were cut out are those indicated by letters *a*, *b*, *c* and *d* as shown in the left half of FIG. 4. Here, position *a* represents the outer periphery of a larger outer diameter A $\phi$ at the upper end, *b* the inner periphery of an inner diameter B $\phi$ at the upper end, *c* the outer periphery of a smaller outer diameter C $\phi$ at the lower end, and *d* the inner periphery of the inner diameter B $\phi$ at the lower end. Respective specimens were shaped in a cube having a side length smaller than one fifth of the height D. An example of the values of A, B, C and D was A = 45 mm, B = 10 mm, C = 20 mm and D = 12.5 mm. Cubic specimens having a side length of 2 mm were cut from said positions of the magnet of the above example and subjected to measurements of their magnetic properties. The results are shown in Table 1.

Table 1

| Specimen | Residual induction $B_r$(G) | Coercive force ${}_BH_c$ (Oe) | Energy product $(BH)_{max}$ ($\times 10^6$G.Oe) |
|---|---|---|---|
| a | 3,100 | 1,700 | 1.8 |
| b | 3,550 | 1,550 | 2.0 |
| c | 4,300 | 2,350 | 4.5 |
| d | 5,300 | 2,000 | 4.8 |

A magnetron having the structure of FIG. 3 was formed using two magnets having the above properties. The field space enclosed by the iron yoke member 11 had dimensions of 55 mm $\phi$ in diameter and 45 mm in height. The weight of one magnet was 50.4 g.

With a pair of magnets each having a thickness D = 15 mm, a magnetic induction of $B_g$ = 1650 G was obtained in the gap between the magnets. As a magnetron device, an output of 800 W was provided at an anode voltage of 4.35 kV, and an anode current of 280 mA and thus the efficiency was 66 %. A remarkable feature of the magnet of this invention is the fact that the magnetic properties become better as the position approaches nearer to a tip portion and the coercive force is greater as the position approaches nearer to the outer periphery as is evident in Table 1, whereby the focusing effect for the magnetic flux is extremely good. This general tendency holds regardless of the dimensions A, B, C and D.

(EMBODIMENT 2)

Although the Mn—Al—C magnets were shaped by one plastic deformation processing in Embodiment 1, successive processings were employed in this embodiment to further improve the magnetic properties of the magnets. As the primary processing, the cost and heat treated billet were extruded at a temperature of 720° C. Then, the extruded material was plastically shaped by upsetting pressing to a predetermined shape.

Namely, a cast cylindrical billet having an outer diameter of 60 mm $\phi$, an inner diameter of 10 mm $\phi$ and a length of 100 mm was prepared first. After a heat treatment, the cast cylinder was subjected to warm extrusion to form a cylinder having an outer diameter of 40 mm $\phi$, an inner diameter of 10 mm $\phi$ and a length of about 230 mm. Such a processed cylinder had a direction of easy magnetization along the axial direction and was uniform. Magnetic properties measured in slices cut perpendicularly to the axis were $B_r = 6300$ G, ${}_BH_c = 2300$ Oe, and $(BH)_{max} = 6.2 \times 10^6$ G·Oe.

After cutting the extruded cylinder obtained from the primary processing at an appropriate length, the material was subjected to upsetting press processing at a temperature of 680° C to provide a shaped product having dimensions of A = 40 mm, B = 10 mm, C = 18 mm, and D = 10 mm. Specimens were cut from a shaped product similar to the case of Embodiment 1 and their directions of easy magnetization and magnetic properties measured. The directions of easy magnetization showed convergence to the axial direction similar to the case of Embodiment 1. The magnetic properties measured in the specimens cut from the positions *a*, *b*, *c*, and *d* and with respect to the axial direction were as shown in Table 2.

Table 2

| | $B_r$ (G) | ${}_BH_c$ | $(BH)_{max}$($\times 10^6$G.Oe) |
|---|---|---|---|
| a | 6350 | 2500 | 6.6 |
| b | 6400 | 2550 | 6.8 |
| c | 6450 | 2800 | 7.2 |
| d | 6500 | 2750 | 7.5 |

A magnetron having the structure of FIG. 3 was formed using a pair of the above magnets. The weight of each magnet was about 26.9 g and the field space surrounded by the iron yoke member 11 had dimensions of a diameter 50 mm $\phi$ and a height 41 mm. A magnetic induction in the gap of $B_g = 2000$ G was obtained with a thickness of the magnets D = 15 mm and the gap distance $L_g = 15$ mm. As a magnetron, an output of 800 W was provided at an anode voltage of 4.7 kV and an anode current of 250 mA and the efficiency was 68 %.

In the above two embodiments, the magnets were subjected to warm plastic deformation processing including shaping of the inner diameter. It is also possible to shape only the outer form by plastic deformation processing in similar fashion and to open an inner hole by mechanical processing such as drilling. The magnetic properties of such processed magnets were hardly different from those of Embodiments 1 and 2.

According to the above embodiments, miniaturization of the magnet and the whole magnetron device can be made to a great extent compared to the conventional devices, by disposing Mn—Al—C magnet members tapered into a truncated cone shape by plastic processing within a vacuum vessel of the magnetron thereby focusing the magnetic flux and reducing leak magnetic flux.

When an attempt is made to form a magnetron having a structure in which magnets are built in a vaccum vessel as shown in FIG. 3 with the use of a usual magnet material such as Alnico 5 DG, $(BH)_{max} = 5 \times 10^6$ G·Oe, for satisfying the conditions of $L_g = 15$ mm and $B_g = 1500$ G a diameter of D = 54 mm is necessary for each magnet. Thus, even though the diameter can be reduced, the height becomes large. This is unfavorable in practical use. If the length D is decreased below 30 mm for the purpose of miniaturization, $B_g$ becomes less than 900 G. For achieving radio-frequency oscillation, the anode voltage should be nearly proportional to the gap magnetic induction $B_g$. Thus, with a gap magnetic induction of the order of 900 G, the anode voltage becomes low and a much larger anode current is required for providing an output in the order of conventional ones. Such anode current exceeds the allowable current range. Consequently, only magnetrons of small output can be provided.

On the other hand, anisotropic ferrite materials are sintered magnet materials and a hence include pores between grains and considerable amount of gas molecules are absorbed therein. Thus, ferrite materials are inadequate for sealing in a vacuum vessel. Further, welding or soldering for sealing ferrite materials in a vacuum vessel is also impossible. The thermal conductivity of ferrites is generally small and the heat dissipation from the heater becomes difficult if a ferrite magnet is contained in a vacuum vessel. Further, ferrite materials are weak against thermal shock and hence cannot be used within a vacuum vessel.

Figure 2:
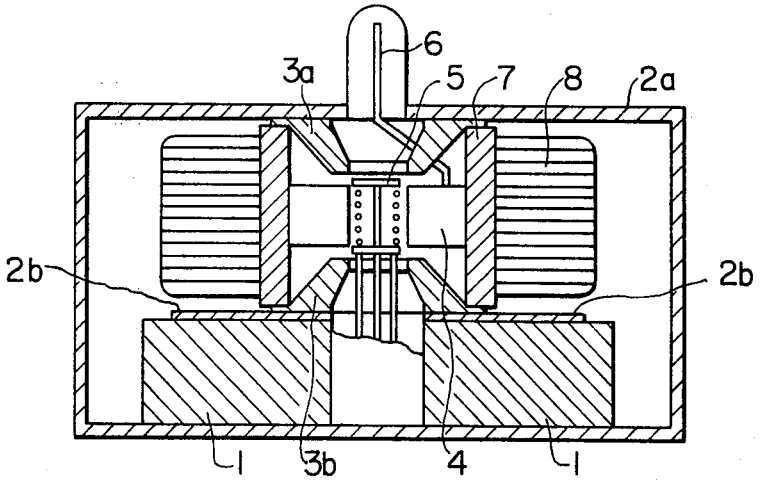
FIG. 2 PRIOR ART

Compared with a conventional magnetron of the structure of FIG. 2 employing a ferrite magnet, the magnetron of this embodiment has such advantages that leak magnetic flux is largely eliminated to enable a nearly perfect utilization of the magnetic flux, the size of the magnet is reduced to about 1/5 in volume, yet the effective magnetic induction in the gap of the intraction space is increased by about 15 % and the total volume of the magnetron is reduced to about 1/3.

Figure 5:
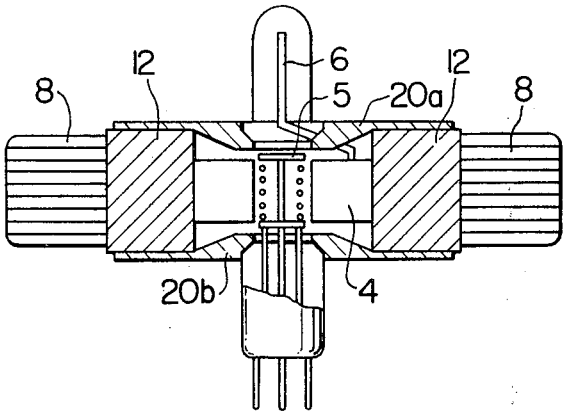
FIG. 5 to 10 are cross sections of the structures of magnetrons according to further embodiments of this invention.

FIG. 5 shows another embodiment of the magnetron according to this invention in which a Mn—Al—C alloy magnet shaped in a cylindrical form is also used as an anode cylinder and as part of a vacuum vessel.

A magnet 12 and pole pieces 20*a* and 20*b* are hermetically welded or soldered. The cylindrical magnet 12 of Mn—Al—C alloy is made as follows. A cylindrical billet of an outer diameter 120 mm $\phi$ and an inner diameter 40 mm $\phi$ was cast. This billet was subjected to extrusion processing at a temperature of 700° C into another cylinder having an outer diameter of 60 mm $\phi$ and an inner diameter of 40 mm $\phi$. The material became an anisotropic magnet having directions of easy magnetization along the axial direction after the warm extruding. As the result of magnetic measurements made on specimens cut perpendicularly to the axis, it was found that there existed a larger anisotropy, larger axial components of the direction of easy magnetization, and better magnetic properties such as the coercive force in the neighborhood of the outer periphery than in the neighborhood of the inner periphery. Therefore, when the distribution of the magnetic flux in the side surfaces of the conventional and the present magnets magnetized in the axial direction was examined with the use of a micro-Hall element, cast magnets such as Alnico 5 DG had considerable degrees of leak in the radial direction and were not perfectly anisotropic magnets in the axial direction since the side surfaces thereof were formed of chilled crystals whereas the Mn—Al—C alloy magnets had almost no leak of magnetic flux. Further, the magnetic properties of the Mn—Al—C alloy magnet in the axial direction were $B_r = 6400$ G, ${}_BH_c = 2450$ Oe, and $(BH)_{max} = 6.6 \times 10^6$ G·Oe.

Figure 1:
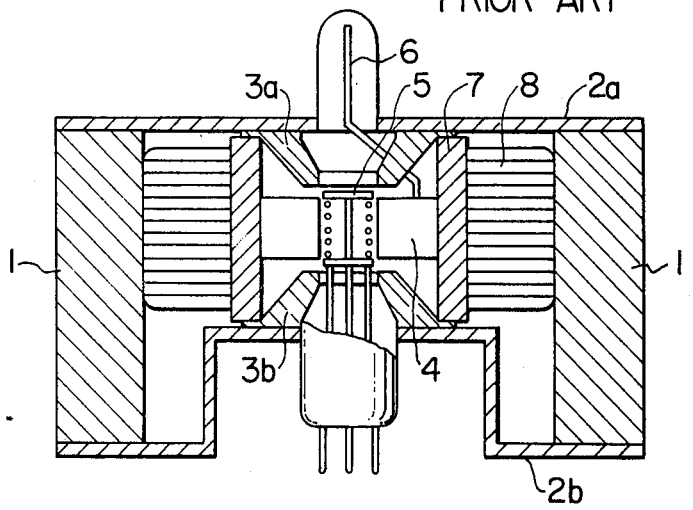
FIG. 1 PRIOR ART
FIGS. 1 and 2 are cross sections of the structures of conventional magnetrons.

The structure of FIG. 5, in which a permanent magnet 12 is also used as an anode cylinder and further as part of a vacuum vessel, has been made possible by novel and positive utilization of the various properties of anisotropic Mn—Al—C system alloy magnet shaped by warm plastic deformation processing for the magnetron device. For example, Alnico magnets have a small coercive force and the optimum permeance thereof is large. Therefore, the achievement of the structure of FIG. 5 with the use of an Alnico magnet is impossible. Further, it is also completely impossible with the use of a ferrite magnet or a recently developed rare earth-cobalt magnet since the hermeticity, outgas, thermal, electrical and welding properties thereof are extremely poor. Only by the use of a Mn—Al—C system alloy magnet, the structure of FIG. 5 is made possible since a large amount of heat generated by the anode loss can be effectively transmitted to the outside through the permanent magnet 12, the leak of the magnetic flux is small since the magnetic resistance between the magnetic poles 20*a* and 20*b* and the magnet 12 are small as they are in close proximity, and the longitudinal length of the magnet can be reduced sufficiently to be less than those of the conventional anode cylinders because of the high coercive force. Thus, the height of the magnetron of FIG. 5 can be reduced below 60 % of that of the conventional magnetron together with a considerable reduction in weight. In one aspect, the magnetic poles 3*a* and 3*b* and the magnetic yokes 2*a* and 2*b* of the conventional structures of FIGS. 1 and 2 are integrated into the magnetic poles 20*a* and 20*b* and also designed to constitute a vacuum vessel with the magnet 12 in the structure of FIG. 5. Further, it becomes possible to assemble the whole structure by one process of welding, soldering or pressure welding, enabling a great reduction in the steps of assembly.

In the structure of FIG. 5, it can be thought of to form the magnetic poles 20*a* and 20*b* of a permanent magnet in place of forming the anode cylinder 12 of a permanent magnet. The structure of the above embodiment, however, is more advantageous since the height of the magnetron can be reduced to at least 80 % of the conventional one by utilizing a permanent magnet as an anode cylinder and constituting a vacuum vessel therewith. Further, a thick anode cylinder made of copper such as the one indicated by numeral 7 in FIGS. 1 and 2 and which is usually required in the conventional magnetron can be dispensed with. This also enables simplification of the steps of assembly.

Figure 6:
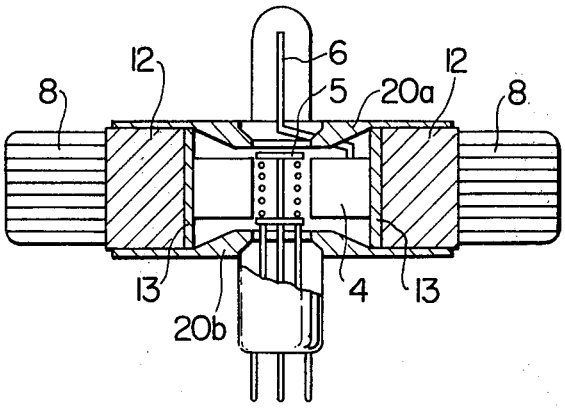

FIG. 6 shows another embodiment in which a thin copper plate 13 having a thermal expansion coefficient similar to that of the magnet 12 is inserted inside the cylindrical permanent magnet 12 of the structure of FIG. 5. Since this copper plate 13 is a good conductor, electrical loss for the radio-frequencies is reduced. Improvement is also made in the strength of soldering or welding. Here, similar effects can also be attained by plating copper or silver on the inside surface of the cylindrical permanent magnet 12 in place of the copper plate 13.

Figure 7:
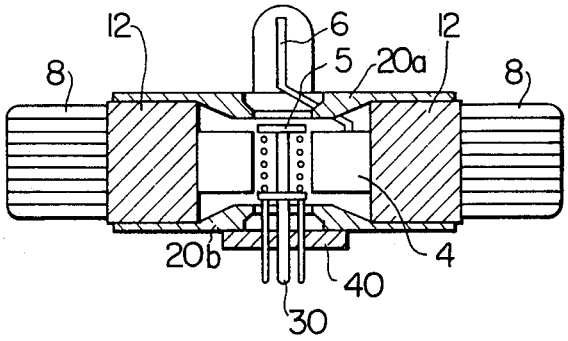

Further, the length of the insulating vessel of the present magnetron can be shortened as shown in FIG. 7. Conventionally, a magnet was provide under the bottom surface of a magnetron tube as shown in FIG. 2 and hence long insulating vessel were required. According to this embodiment of the invention, since a permanent magnet 12 is used also as an anode cylinder as in FIG. 5, a long insulating vessel is no longer required and the external leads 30 can be shortened. Numeral 40 denotes a button insulating plate which is hermetically adhered to the magnetic pole piece 20*b*. Therefore, the height of a packaged magnetron provided with capacitors and solenoids for radio-frequency filtering disposed under the structure of FIG. 7 could be reduced by more than 20 % compared with those of the conventional package magnetron.

Figure 8:
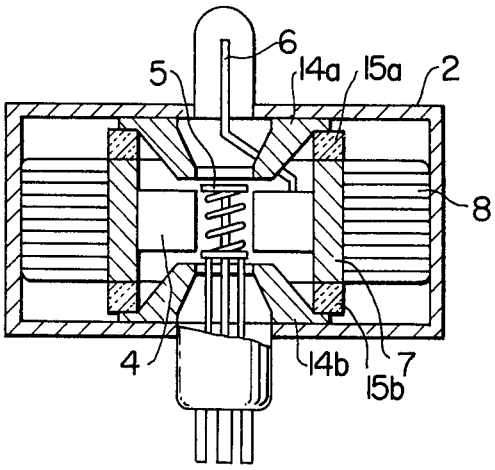

FIG. 8 shows a modification of the embodiment of FIG. 3, in which means for applying a magnetic field is formed of Mn—Al—C alloy magnets 14*a* and 14*b*, and these magnets work also as magnetic pole pieces. As is described in connection with FIG. 3, a superior magnetron may be provided by the above structure. In the case where the anode cylinder 7 and the magnets 14*a* and 14*b* are formed in a unitary structure with direct contacts therebetween, the magnets may be heated to temperatures of 80° to 100° C, similar to the anode cylinder. There arises a little difficulty for fully utilizing the magnetic ability of the magnets due to the demagnetization of the magnets by temperature. If heat insulators 15 are inserted between the anode cylinder 7 and the magnets 14*a* and 14*b*, as shown in FIG. 8, for preventing such loss, the heat transfer from the anode cylinder 7 to the magnets 14*a* and 14*b* is reduced and the magnetic abilities of the magnets can be effectively utilized. When a ceramic material such as glass or aluminium oxide was used as the heat insulator 15, the temperature of the magnets 14*a* and 14*b* could be depressed below 40° C after one minute and below 50 to 70° C after 15 minutes of operation at a radio-frequency output of 600 W. The sealing process can be made easier by plating copper or silver or providing a thin plate of copper, etc. on the heat insulators 15.

Figure 9:
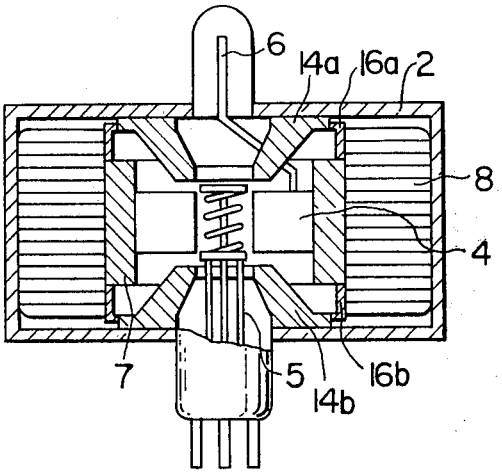

FIG. 9 shows another embodiment of this invention, in which thin metal rings 16 connect the anode cylinder 7 and the magnets 14*a* and 14*b* and seal the inner space. These thin metal rings 16 provide similar effects to those of heat insulators 15 of FIG. 8. Since the rings 16 are formed of thin metal plates, they provide a large thermal resistivity and work as heat insulators. Further, these rings 16 may be formed unitarily with the anode cylinder 7 by reducing the thickness of the cylinder 7 at both ends, for example to less than ½ of that of the central portion.

In this embodiment, thin ring-shaped plates of iron series having a thickness less than ½ of that of the anode cylinder were connected between the anode cylinder 7 and the magnets 14*a* and 14*b*. The heat insulation was very good and effects similar to those of heat insulators 15 of FIG. 8 were obtained. Further, since an electrical connection is also made, this structure is advantageous also from the point of radio-frequencies. The metal rings 16 may also be formed of copper, nickel or alloy of copper (series) or nickel (series).

Figure 10:
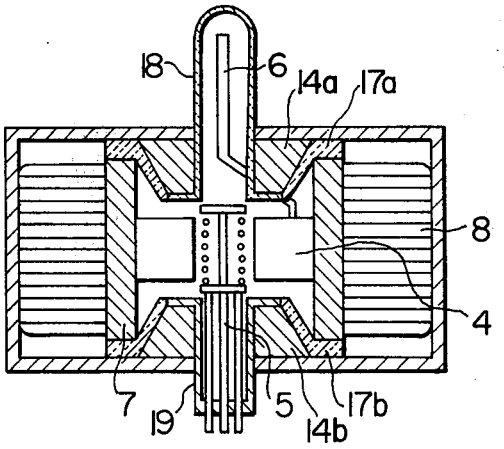

FIG. 10 shows a further embodiment of this invention, in which numerals 17*a* and 17*b* denote heat insulators similar to 15*a* and 15*b* of FIG. 8 respectively.

Insulating vessels 18 and 19 are adhered to heat insulators 17*a* and 17*b*, respectively. Further if the insulating vessels 18 and 19 are formed of a thermally insulating material, they may be formed unitarily with the heat insulators 17*a* and 17*b*, respectively. Further, the provision of electric conductive films on part or whole portion of the heat insulators 17*a* and 17*b* as described above enhances the sealing and is effective with regard to the radio-frequency circuit.

As is apparent from the foregoing description of the preferred embodiments, according to this invention the height of a magnetron can be greatly reduced in comparison with conventional magnetrons. In the case of assembling a magnetron in an electronic oven, the selection of the disposition is made easy. Further, large reductions can be made in the size and weight of a magnetron and the utility of space in an electronic oven can be improved. The leak of magnetic flux can be reduced and the utilization efficiency of the magnetic flux increased so that it is several times larger than the conventional one. Further, it becomes possible to magnetize the magnet after assembling it in a magnetron as the magnetic circuit became short, the assembling steps can be simplified and also the magnet can be used at the optimum performance point so as to sufficiently, effectively utilize the ability of the magnet. Furthermore, it is also possible to assemble the whole magnetron structure unitarily, and large cost reductions and rationalization of manufacturing steps are possible.

Thus, miniaturized, thin and light weight magnetrons of high performance are provided according to this invention.

What is claimed is:

1. In a magnetron having enclosure member surrounding an interaction space for electrons, an anode and a cathode positioned within said enclosure member, and means for applying a magnetic field to said interaction space, the improvement wherein said means for applying a magnetic field comprises at least one permanent magnet for supplying magnetic energy to said interaction space and establishing a magnetic field perpendicularly to the electric field established between said anode and said cathode, said permanent magnet being formed of a manganese- aluminum-carbon system alloy and being disposed within said enclosure member or defining part of said enclosure member.

2. A magnetron according to claim 1, in which said permanent magnet is an anisotropic manganese (Mn)— aluminum(Al)—carbon(C) system alloy magnet having a basic composition of 68.0 to 73.0 weight percent of Mn, (1/10 Mn − 6.6) to (⅓ Mn − 22.2) weight percent of carbon and the remainder aluminum.

3. A magnetron according to claim 1, in which said means for applying a magnetic field comprises pole piece means formed of a pair of said permanent magnets.

4. A magnetron according to claim 3, in which said permanent magnets are in the shape of truncated cones each having a top of smaller diameter than the bottom thereof and wherein said magnets are anisotropic in such a manner that the easy directions of magnetization are oriented to converge toward the smaller diameter tops of said cones, said magnets being disposed with their smaller diameter tops facing each other.

5. A magnetron according to claim 1, in which said permanent magnet has a cylindrical shape and is disposed coaxially with said cathode said permanent magnet functioning as said anode.

6. A magnetron according to claim 5, in which said permanent magnet has an inner side surface provided with a plated layer or a thin electrically conductive.

7. A magnetron according to claim 5, in which said permanent magnet serves as part of said enclosure member.

8. A magnetron according to claim 3, further comprising heat insulator means disposed between said pole piece means and said anode.

9. A magnetron according to claim 3, further comprising thin metal rings disposed between said pole piece means and said anode.

10. A magnetron according to claim 3, further comprising heat insulators disposed around the side surface of said pole piece means.

11. In a magnetron having an enclosure member surrounding an interaction space for electrons, a generally cylindrical cathode and an anode circumferentially disposed about said cathode within said enclosure, and means for applying a magnetic field to said interaction space, the improvement in which said magnetic field applying means includes at least one permanent magnet for supplying magnetic energy to said interaction space and for establishing a magnetic field perpendicularly to the electric field established between said anode and said cathode, said permanent magnet being formed of a manganese-aluminum-carbon system alloy having a basic composition of 68.0 to 73.0 weight percent of Mn, (1/10 Mn − 6.6) to (⅓ Mn − 22.2) weight percent of carbon and the remainder of aluminum, said magnet being anisotropized by warm-plastic deformation and disposed within said enclosure member or defining part of said enclosure member.

* * * * *